United States Patent [19]

Labate

[11] Patent Number: 4,624,292

[45] Date of Patent: Nov. 25, 1986

[54] METHOD AND APPARATUS FOR POURING MOLTEN METAL IN A NEUTRAL ATMOSPHERE

[76] Inventor: Micheal D. Labate, 115 Hazen Ave., Ellwood City, Pa. 16117

[21] Appl. No.: 713,335

[22] Filed: Mar. 18, 1985

[51] Int. Cl.[4] ..... B65B 3/04

[52] U.S. Cl. ..... 141/5; 141/9; 141/70; 141/326; 164/67.1; 220/216

[58] Field of Search ..... 141/326, 325, 327, 1-12, 141/70; 164/67.1; 220/216-226

[56] References Cited

U.S. PATENT DOCUMENTS 4,308,569 12/1981 Rheindorf ..... 141/326

*Primary Examiner*—Houston S. Bell, Jr.

*Attorney, Agent, or Firm*—Harpman & Harpman

[57] ABSTRACT

A method and apparatus for pouring molten metal in a neutral atmosphere into an ingot mold, a trumpet funnel for bottom poured ingots or a tundish box for a continuous caster or like vessel is disclosed wherein the receiving vessel is closed to the atmosphere by a closure having an opening therein through which the molten metal is poured. A ceramic sleeve may be positioned in said opening and wherein the normal atmosphere is replaced by vaporized hexamethylene or cyclohexane as it is sometimes called. The closure with the opening through which the molten metal is introduced into the receiving vessel is positioned on top of the receiving vessel and is engaged by a pouring nozzle in an airtight manner. The closure is provided with break lines or scores that permit the edge portions of the closure to be moved in hinged relation thereto when the closure is pushed downwardly into the receiving vessel to a point on or near the surface of the molten metal.

14 Claims, 7 Drawing Figures

METHOD AND APPARATUS FOR POURING MOLTEN METAL IN A NEUTRAL ATMOSPHERE

This is a continuation in part of application Ser. No. 06/562,831, filed Feb. 6, 1984.

BACKGROUND OF THE INVENTION

1. Technical Field:

This invention relates to a method and apparatus for pouring molten metal into a receiving vessel while excluding atmospheric air therefrom.

2. Description of the Prior Art:

No prior art methods or devices are known whereby a relatively simple and inexpensive closure with or without a pouring sleeve positioned therethrough enable a receiving vessel to be charged with an inert gas and structually prevent the entrace of atmospheric air thereto.

SUMMARY OF THE INVENTION

A method and apparatus for pouring molten metal in a neutral atmosphere are disclosed wherein simple and relatively inexpensive apparatus placed on a receiving vessel forms a closed passageway from a ladle, converter or similar source of molten metal to the receiving vessel and is moved to a position on the molten metal in the receiving vessel when the same is filled to maintain the closure with respect to the atmosphere while the molten metal is discharged from the receiving vessel.

A powdered hot top compound may be and preferably is applied to the surface of the molten metal to insure sealing of the same with respect to the atmosphere and the movable closure and closed passageway.

DESCRIPTION OF THE PREFERRED EMBODIMENT

Figure 1:
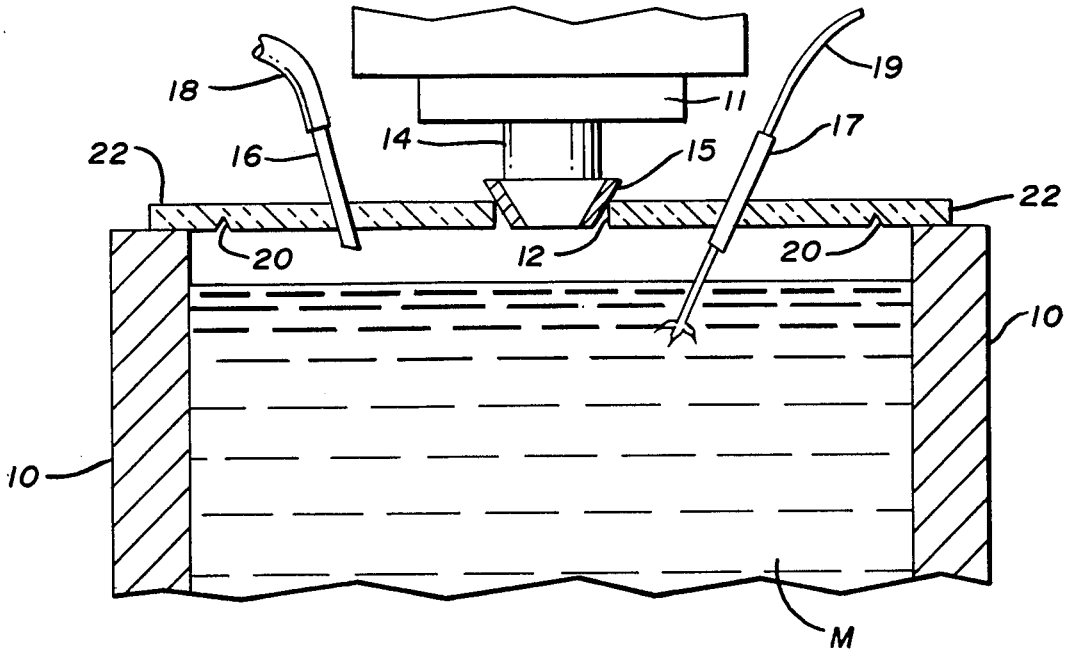
FIG. 1 is a fragmentary vertical section through a portion of an ingot mold and illustrating the atmosphere excluding apparatus in a first position.
Figure 2:
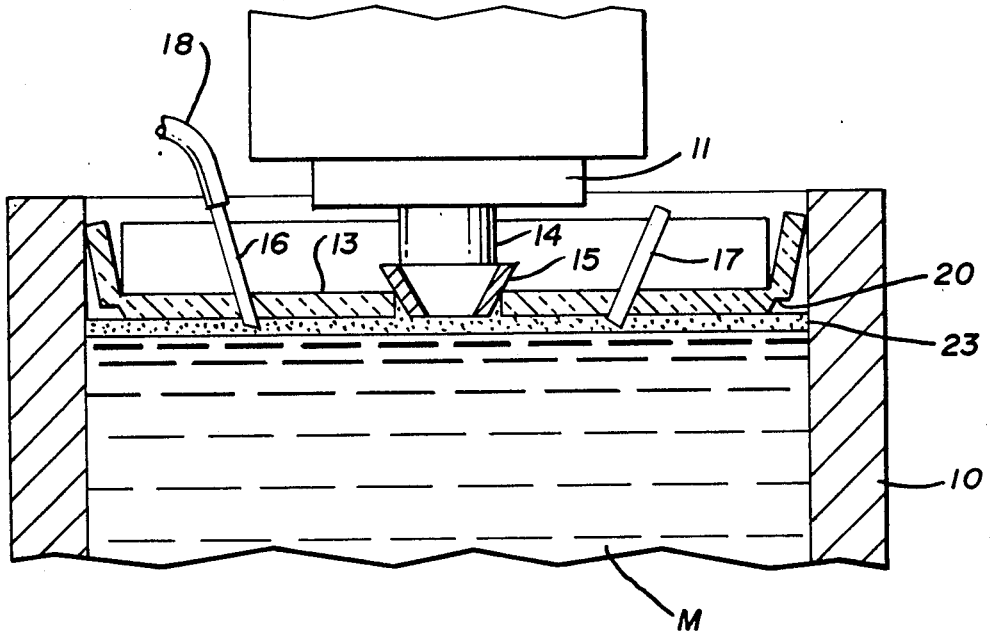
FIG. 2 is a vertical sectional view similar to FIG. 1 showing the atmospheric excluding apparatus in a second position in an ingot mold.
Figure 4:
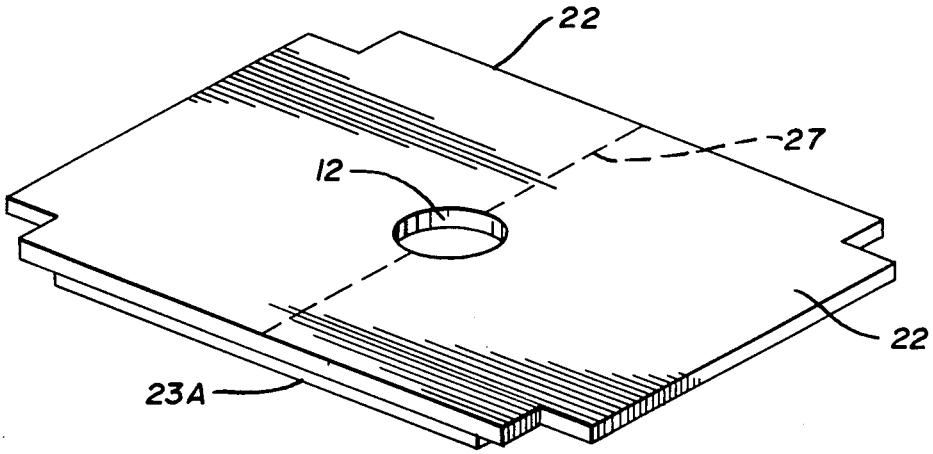
FIG. 4 is a perspective view showing the apparatus of FIGS. 1 and 3.

By referring to the drawings and FIG. 1 in particular, a fragmentary view of the upper portion of a receiving vessel 10 which may be an ingot mold or a trumpet funnel of a bottom poured ingot mold or a tundish box for a continuous caster will be seen to be substantially filled with molten metal M which has been introduced into the receiving vessel 10 from a ladle 11 or other source of molten metal. The molten metal M is introduced into the receiving vessel 10 through an opening 12 located in a closure 13 positioned on the open upper end of the receiving vessel 10. The closure 13 may be a sheet-like section of insulating fiber board or the like. The opening 12 in the closure 13 is formed substantially centrally thereof as may be seen by referring to FIG. 4 of the drawings.

Molten metal is introduced into the opening 12 of the closure 13 from the ladle or other source of molten metal by way of a tubular nozzle 14, the lower end portion of which is provided with an air lock gasket 15 formed of suitable refractory fiber materials and the like which is of an overall tapered shape and thereby capable of registering in the opening 12 in the closure 13 and forming an airtight closure.

A pair of pipes 16 and 17 may be positioned through the horizontal wall of the closure 13, the pipe 16 being connected by a flexible hose 18 with a source of inert gas, such as argon, and the pipe 17 provides a suitable lead-in for an alloy wire 19 which can be introduced into the molten metal therethrough as desired.

Figure 3:
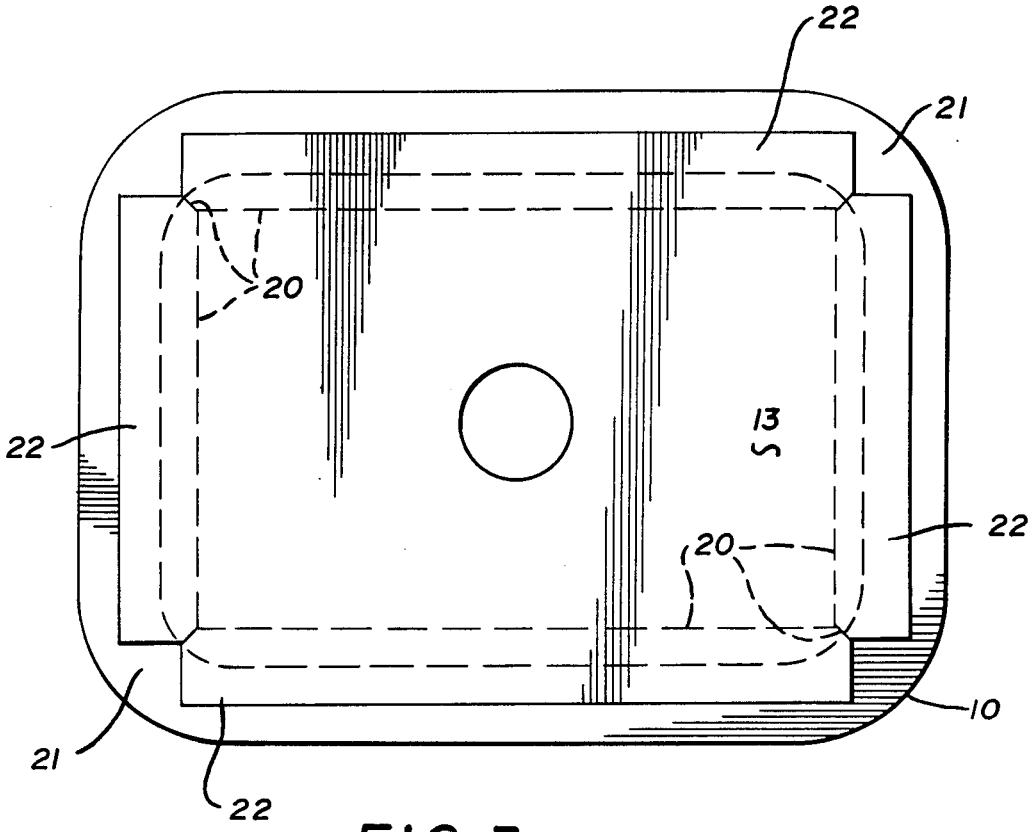
FIG. 3 is a top plan view of the apparatus seen in FIG. 1.

Still referring to FIG. 1 of the drawings, it will be seen that the lower surface of the closure 13 of insulating fiber board or the like is provided with fold or score lines 20 defining a rectangular or other shape slightly smaller than the inner rectangular or other shape of the receiving vessel 10 and by referring to FIG. 3 of the drawing, a top plan view of the apparatus enabling the pouring of molten metal in a neutral atmosphere will be seen to include broken line representations of the fold lines or score lines 20 together with diagonal extensions thereof at the four corners of the closure 13 and connecting with the cut out corners thereof as indicated by the numerals 21.

At such time as the receiving vessel 10 is filled to a desired level and the inert gas flow continues, an edge portion 22 of the closure 13 and/or the ladle 11 and nozzle 14 is lifted and a covering coating of powdered hot top compound 23, as known in the art, is applied to the surface of the molten metal. The horizontal sheet-like section of the closure 13 of insulating fiber board or the like is then pushed downwardly so as to bend the longitudinal edge portions 22 thereof in angular relation thereto and form four angularly disposed edge sections resembling wipers, each attached to the sheet-like closure 13 of insulating fiber board or the like and each continuously engaging the inner walls of the receiving vessel 10 so as to form an airtight closure.

When the horizontal section of the closure 13 is pushed downwardly to contact either the molten metal M or the powdered hot top compound floating thereon, a secondary closure, not shown, may be placed in the opening 12 to effectively seal the surface of the molten metal in the vessel 15. At the same time the pipes 16 and 17 may be disconnected from their respective sources of gas or metal and/or removed completely and as the molten metal M in the receiving vessel 10 is fed therefrom, as for example into a continuous caster, the entire sealing apparatus descends with the level of the molten metal M and maintains the atmospheric seal.

In order to insure the existence of a desirable neutral atmosphere in the receiving vessel 10 when the first molten metal is poured therein, a small quantity of hexamethylene, also known as cyclohexane, or any other similar readily vaporizable liquid having similar properties is introduced into the receiving vessel 10 when the closure apparatus is first installed so that the introduction of the first molten metal into the receiving vessel will immediately vaporize the same and create a suitable gaseous environment that will expel all of the usual atmosphereic air from the receiving vessel 10 and thus prevent contamination by the reoxidation of the molten metal and the undesirable products thereof.

Modifications in the apparatus for pouring molten metal in a neutral atmosphere will occur to those skilled in the art and one such modification may comprise the addition of exothermic material as known in the art into the closure 13 of insulating fiber board or the like and/or attaching sections of exothermic material 23A to the lower surfaces of the closure 13 of insulating fiber board or the like so that the reaction of the exothermic material will add additional heat to the metal in the receiving vessel and avoid the usual piping problems that occur, for example when molten metal soldifies in an ingot mold or the like.

Figure 5:
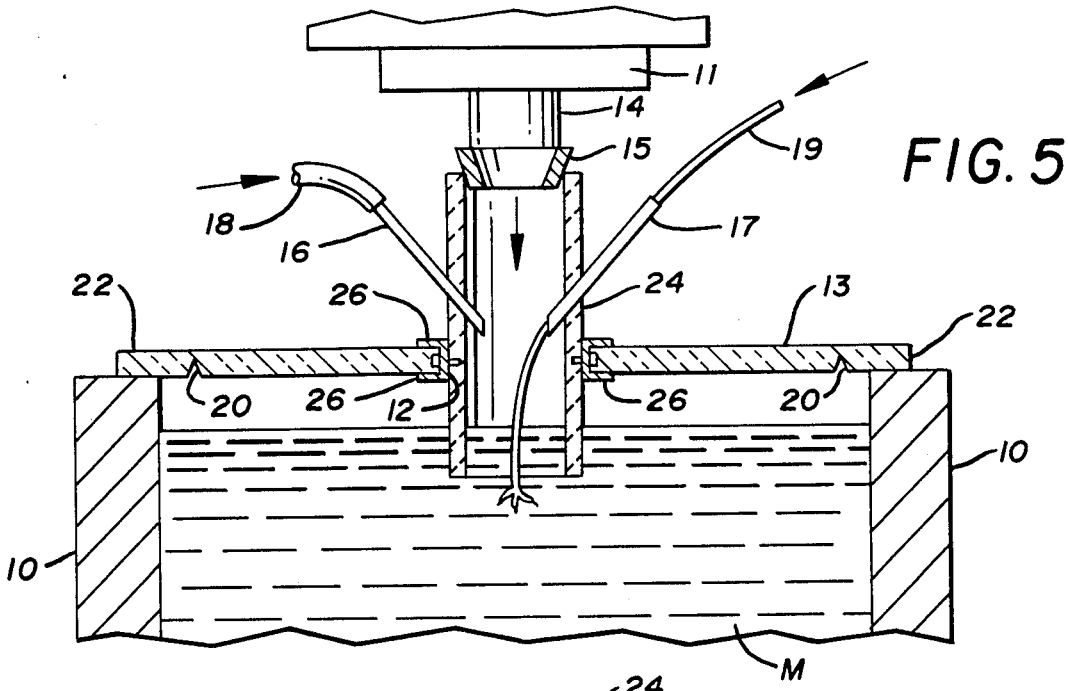
FIG. 5 is a fragmentary vertical section through a portion of an ingot mold and a modified atmospheric excluding apparatus in a first position thereon.
Figure 6:
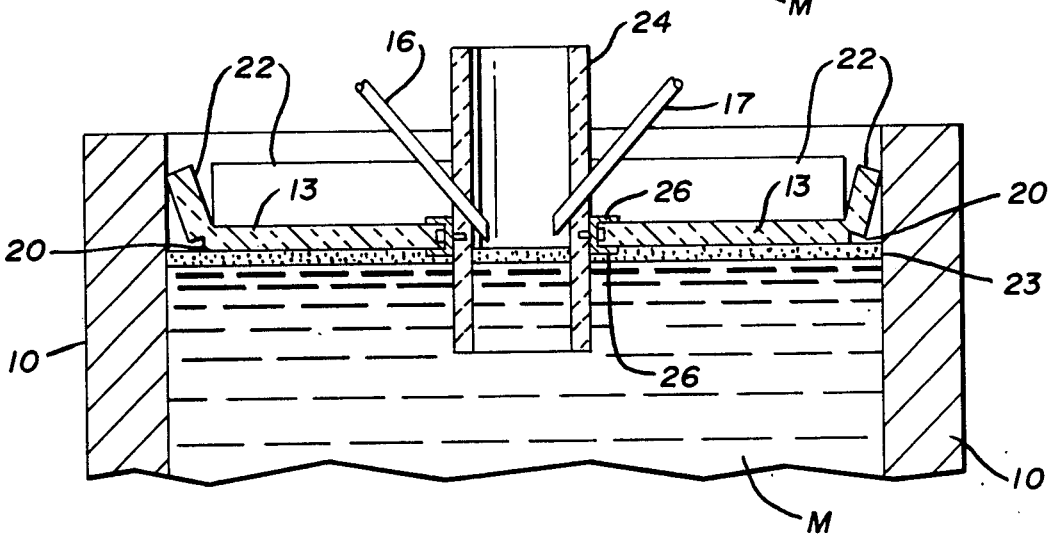
FIG. 6 is a vertical sectional view similar to FIG. 5 showing the atmospheric excluding apparatus in a second position in the ingot mold.
Figure 7:
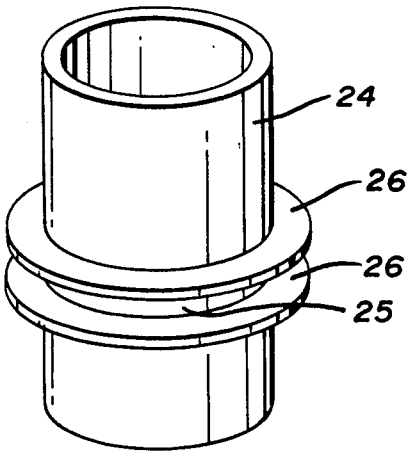
FIG. 7 is a perspective view on an enlarged scale showing a ceramic sleeve which is also seen in FIGS. 5 and 6 of the drawings.

Another modification comprises the use of a ceramic sleeve 24 positioned in the opening 12 of the closure 13 as seen in FIGS. 5,6 and 7 of the drawings. By referring thereto it will be seen that this modification uses an annular metal band 25 having vertically spaced horizontally extending annular flanges 26 attached to the ceramic sleeve 24 by suitable fasteners and receiving the edges of the closure 13 defining the opening 12 therein. If desired, the closure 13 may be formed in two pices abutting one another as shown by a broken line 27 in FIG. 4 of the drawings, to simplify the placement of the annular band 25, the flanges 26, and the ceramic sleeve 24 in the opening 12 of the closure 13. In this modification, the pipes 16 and 17 hereinbefore described may be relocated in the ceramic sleeve 24 as seen in FIGS. 5 and 6.

It will be understood by those skilled in the art that the ceramic sleeve 24 of the modification is formed of refractory materials that readily withstand the temperature of molten metal and that the closure 13 is formed of refractory fibers such as aluminum silicate in a mixture which may include dolomite, sodium silicate, pink clay, mineral wool, etc. and a suitable binder material such as a phenol formaldehyde resin.

The closure 13 may be provided with a transverse fold line so that it may be folded for shipping. See F in FIG. 3.

The apparatus disclosed herein makes possible a method of pouring steel or other metal in a receiving vessel such as an ingot mold, trumpet funnel mold for bottom poured ingots or tundish boxes for continuous casters without subjecting the molten metal to the normal atmosphere and thereby reduces or eliminates the possibility of products of reoxidation forming in the molten metal as would otherwise occur. The method comprises the introduction into the receiving vessel of a known quantity of hexamethylene capable of forming a gaseous cloud upon subjection to molten metal initially contacting the same and acting to purge the normal atmosphere from the receiving vessel, providing a closure of insulating fiber board or the like with an opening therethrough which may have a ceramic sleeve in the opening in the closure and positioning the closure with or without the ceramic sleeve on the top of the receiving vessel, sealing the edges of the closure to the upper surfaces of the receiving vessel, bringing an outlet port nozzle of a ladle or the like source of molten metal into engagement with the opening in the closure or against the upper end of the ceramic sleeve, directing molten metal through said opening or the ceramic sleeve into said receiving vessel to a desired height therein, adding a topping of powdered hot top compound, such as acid treated graphite or a similar material to the surface of the molten metal and moving the closure with or without the ceramic sleeve downwardly onto the surface of the molten metal and the hot topping compound thereon and permitting said closure to move downwardly in the receiving vessel with the molten metal when the same is withdrawn therefrom so as to maintain a continuous seal with the receiving vessel and prevent the introduction of atmospheric air into the receiving vessel and its contact with the molten metal therein.

The horizontally disposed heat resistant closure 13 is preferably formed of low thermal conductivity refractory material such as inorganic fibrous material, particulate material and an organic binder; the inorganic fibrous material being selected from the group consisting of asbestos, calcium silicate fiber, aluminosilicate fiber and alumina fiber; the particulate refractory material being selected from a group consisting of silicia, alumina, zircon, olivine, magnesia, aluminosilicates and carbonaceous materials; and the organic binder being selected from the group consisting of synthetic resins, natural resins and carbohydrates.

It will thus be seen that a method and apparatus for pouring molten metal into an ingot mold or a tundish box or a continuous caster has been disclosed which is relatively simple to perform with the use of a relatively inexpensive apparatus and it will be observed that the apparatus is formed of materials including inorganic fibrous material, particulate refractory material and ceramic material which may be easily discarded and replaced when eroded by contact with the molten metal protected thereby.

Having thus described my invention, what I claim is:

1. The combination of a molten metal receiving vessel having substantially vertically standing walls and means for closing said vessel to the atmosphere and directing molten metal into said closed vessel; said means including a horizontally disposed closure formed of a low thermal conductivity refractory material having an opening therein, said opening positioned for registry with a nozzle of a ladle, said material about said opening forming air lock gasket means engaging said nozzle, said closure being movable from a first position on a lip portion of said vessel to a second position in said vessel engaging molten metal therein and arranged to float on said molten metal when the level of said molten metal falls below said second position.

2. The combination of claim 1 wherein horizontally disposed closure is a sheet-like shape larger than and corresponding to the shape of the vessel and overlying the same.

3. The combination of claim 2 wherein the sheet-like shape of the horizontally disposed closure has score lines in its lower surface defining an area smaller than the interior of said vessel and wherein the edge portions of the sheet-like shape beyond the score lines are bendable upward in hinged relation to said sheet-like shape when said closure moves into said second position.

4. The combination of claim 1 wherein the material of which said closure is formed includes fibers in at least the area of said opening for registry with said nozzle of said ladle to form said air lock gasket means.

5. The combination of claim 1 and wherein the material of which said closure is formed comprises inorganic fibrous material, particulate refractory material and a binder.

6. The combination of claim 3 and wherein the inorganic fibrous material is selected from the group consisting of asbestos, calcium silicate fiber, aluminosilicate fiber and alumina fiber.

7. The combination of claim 5 wherein the binder is an organic binder selected from the group consisting of synthetic resins, natural resins and carbohydrates.

8. The combination of claim 1 and wherein said closure also carries an exothermic component.

9. A closure for a tundish of a continuous caster and the like, said closure comprising a deformable heat resistant fiber board having an opening therein, said closure being movable from a first position on said tundish to a second position in said tundish engaging said hot metal therein and arranged to float on said hot metal when the level of said hot metal falls below said second position, heat resistant air lock gasket means on said closure around said opening positioned to receive the nozzle of a hot metal ladle in sealing relation and means in said closure for introducing argon gas and the like into said tundish and for feeding lead wire and the like into said tundish simultaneously with hot metal directed through said opening from the nozzle of said ladle.

10. The method of pouring molten steel into a tundish on a continuous caster in an oxygen free atmosphere comprising the steps of sequentially; placing a flat closure on said tundish in air sealing realtion thereto; placing a known quantity of hexamethylene in said tundish; engaging the nozzle of a ladle in sealing relation to said opening; pouring molten steel through the nozzle of the ladle through said opening and into said tundish so as to vaporize said hexamethylene to fill said tundish and expel atmospheric air therefrom; pouring molten steel through said nozzle and opening to fill said tundish with said molten seel to a level adjacent said closure; moving said closure into said tundish to rest on said molten steel.

11. The method of claim 10 wherein a portion of said closure is moved away from said tundish sufficiently to permit a hot topping compound to be placed on said molten steel when said molten steel in said tundish reaches said level adjacent said closure and replacing said portion of said closure on said tundish.

12. The method of pouring molten steel into an ingot mold in an oxygen free atmosphere comprising the steps of sequentially; placing a flat closure on said ingot mold in air sealing relation thereto; said closure having an opening therein; placing a known quantity of hexamethylene in said ingot mold; engaging the nozzle of a ladle in sealing relation in said opening; pouring molten steel through the nozzle of the ladle through said opening and into said ingot mold so as to vaporize said hexamethylene to fill said ingot mold and expel atmospheric air therefrom; pouring molten steel through said nozzle and opening to fill said ingot mold with said molten steel to a level adjacent said closure; moving said closure into said ingot mold float on said molten steel.

13. The combination of a molten metal receiving vessel having substantially vertically standing walls and means for closing said vessel to the atmosphere and directing molten metal into said closed vessel, said means including a horizontally disposed closure formed of a low thermal conductivity refractory material having an opening therein, said opening positioned for registry with a nozzle of a ladle, and material about said opening forming an airlock gasket means engaging said nozzle, said closure being movable from a first position on a lip portion of said vessel to a second position in said vessel adjacent molten metal therein and arranged for movement toward said molten metal when the level of said molten metal falls below said second position.

14. The method of pouring molten steel into an ingot mold in an oxygen free atmosphere comprising the steps of sequentially; placing a flat closure on said ingot mold in air sealing relation thereto; said closure having an opening therein; placing a known quantity of hexamethylene in said ingot mold; engaging the nozzle of a ladle in sealing relation in said opening; pouring molten steel through the nozzle through said opening and into said ingot mold so as to vaporize said hexamethylene to fill said ingot mold and expel atmospheric air therefrom; pouring molten steel through said nozzle and opening to fill said ingot mold with said molten steel to a level adjacent said closure; moving said closure into said ingot mold to a position adjacent said molten steel.

* * * * *